United States Patent [19]

Lohrberg

[11] 4,247,375

[45] Jan. 27, 1981

[54] PROCESS OF ELECTROLYZING AQUEOUS SOLUTION OF ALKALI HALIDES

[75] Inventor: Karl Lohrberg, Heusenstamm, Fed. Rep. of Germany

[73] Assignee: Metallgesellschaft Aktiengesellschaft, Frankfurt am Main, Fed. Rep. of Germany

[21] Appl. No.: 62,270

[22] Filed: Jul. 30, 1979

[30] Foreign Application Priority Data

Aug. 26, 1978 [DE] Fed. Rep. of Germany ..... 2837313

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 3,438,879 4/1969 Kircher et al. ..... 204/95

3,793,163 2/1974 Dotson ..... 204/98

OTHER PUBLICATIONS

General Chemistry by H. H. Sisler et al., 1949, p. 424.

*Primary Examiner*—R. L. Andrews

*Attorney, Agent, or Firm*—Sprung, Felfe, Horn, Lynch & Kramer

[57] ABSTRACT

An improvement in a process of electrolyzing an aqueous solution of an alkali metal halide in a membrane cell in which a pH above 1.0 is maintained in the anode chamber, the alkali metal halide solution is removed from the anode chamber and its concentration and pH are increased is described. The improvement resides in thereafter decreasing the pH of at least a portion of the resultant solution to below 1.0 and thereafter adjusting the pH to 1.0 to 6.0 and returning the so adjusted solution to the anode chamber.

10 Claims, 1 Drawing Figure

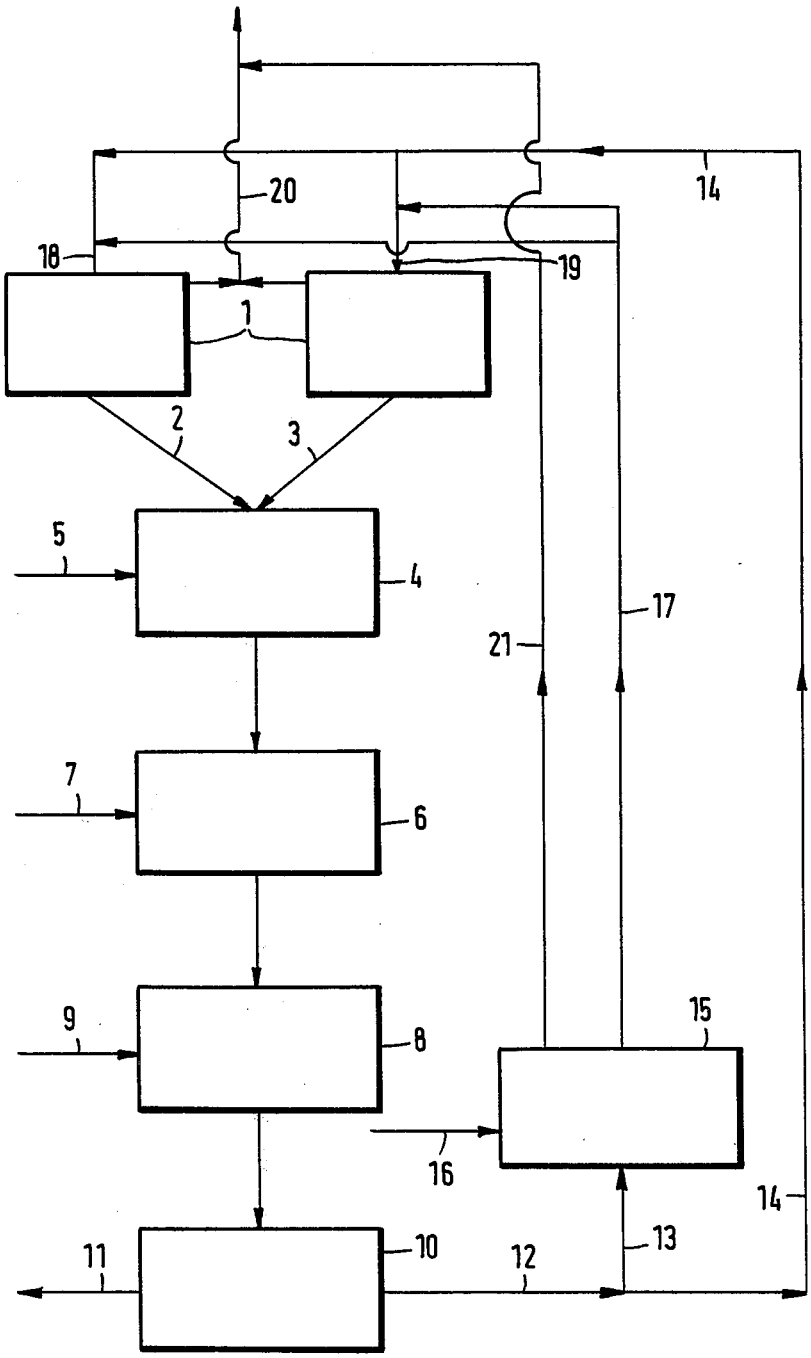
20
14
18
19
1
2
3
5
4
17
21
7
6
9
8
15
16
14
13
11
10
12

PROCESS OF ELECTROLYZING AQUEOUS SOLUTION OF ALKALI HALIDES

BACKGROUND OF THE INVENTION

1. Field of the Invention

This invention relates to a process of electrolyzing aqueous solutions of alkali halides in membrane cells in which pH values above 1.0 are maintained in the anode chamber and the alkali solution is moved through the anode chamber and through zones in which it is strengthened to increase its alkali halide concentration and its pH value is adjusted.

2. Discussion of the Prior Art

Mainly two processes, namely, the amalgam and the diaphragm process, have been available until recently for the electrolysis of alkali halide solutions, mainly sodium chloride solutions. The amalgam process affords the advantage of permitting of manufacture of highly concentrated alkaline solutions of high purity for pollution control. The diaphragm process does not involve such expenditures but permits only of a production of alkaline solutions having a much lower concentration and having considerable contents of alkali halides.

When it had become possible to provide so-called ion exchange membranes which are chemically resistant, hydraulically impermeable and permeable substantially only to cations, membrane processes using such ion exchange membranes gained increased importance. It is believed that the membrane process will be the process of the future.

In the membrane process the anode and cathode chambers of the electrolytic cell are separated by an ion exchange membrane, through which substantially only the alkali metal ions can permeate. These ions are electrically neutralized at the cathode and when contacted with water in the anode chamber form alkaline hydroxide solution and hydrogen. Something halogen gas is electrolitically formed released only in the anode chamber.

When the presently known ion exchange membranes are used, part of the OH ions formed in the cathode chamber inevitably migrate through the membrane into the anode chamber. For instance, in the electrolysis of sodium chloride the losses in efficiency amount to 5 to 20% depending upon the quality of the membrane and its time of use. The entrance of OH ions into the anode chamber accounts for about $\frac{2}{3}$ of such losses. In the anode chamber, the OH ions in contact with halogen gas form oxyacids of chlorine or the salts of such acids, particularly hypochlorite and chlorate, depending on the pH value of the anolyte, and these acids or salts can be destroyed only by addition of acid.

The formation of oxyacids of chlorine and/or the salts of such acids is also responsible for the decrease of the solubility of the alkali halide. As a result, the discharge potential is shifted toward the less noble side, in an extreme case by about 50 mV.

To eliminate the disadvantage which has been described hereinbefore, it is known to use an acid anolyte in a membrane cell for electrolysis and to add so much hydrochloric acid to the brine that the entering ions are just neutralized (D. Bergner "Elektrolytische Chlorerzeugung nach dem Membran-Verfahren", Chemiker-Zeitung 101 (1977), pages 433 to 447). It is also known to add so much acid that the anolyte is adjusted to a pH value in the range of about 1 to 5, preferably between 3.0 and 4.0, (West German Offenlegungsschrift No. 24 09 193) or about 2 (West German Offenlegungsschrift No. 26 31 523). In the process disclosed in U.S. Pat. No. 3,948,737, the pH value of the anolyte should not exceed 4.5 and should preferably lie between 2.5 and 4.0 although pH values of below 1.0 are also permitted.

Whereas an adjustment to a low pH value is recommendable for destruction of oxyacids of chlorine and of the salts of such acids, very high hydrogen ion concentrations have the disadvantage that they cause hydrogen ions to migrate through the membrane into the cathode chamber where they react with the alkaline solution and thus decrease the current efficiency with respect to the production of such alkaline solution. It is apparent that the current efficiency is thus increased as far as the production of halogen is concerned but decreased with respect to the production of alkaline solution (D. Bergner, l.c.).

It is object of this invention to provide a process which can be carried out in a simple manner and which avoids the disadvantages of the known processes and produces desirable results in respect of the yields of both halogen and alkali metal hydroxide solution are concerned.

SUMMARY OF THE INVENTION

This object is accomplished in that the process of the kind described first hereinbefore is carried out in accordance with the invention in such a manner that the solution whose concentration of alkali metal halide and where pH have been increased is thereafter adjusted, at least in part, to a pH value below 1.0 and said solution is subsequently adjusted to a pH value in the range of 1.0 to 6.0 and thereafter fed to the anode chamber.

In principle, the entire alkali metal halide solution may be adjusted to a pH value below 1 and alkaline solution may subsequently be added to adjust the solution to a higher pH value.

It will be particularly desirable, however, to treat only a partial stream amounting to up to 20%, preferably 8 to 15%, and to so much acid that the desired pH value in the range of 1.0 to 6.0 is achieved when the partial stream has been recombined with the main stream.

For instance, a partial stream amounting to 8% may be removed from the alkali metal halide solution, which usually has a pH value of about 11 when leaving the zones in which it has been saturated with alkali metal halide, precipitated and filtered to remove impurities, and said partial stream may be adjusted to a pH value of 0.4 if a final pH value of 1.5 is desired in the recombined streams. Under the same conditions, a partial stream of 15% should be adjusted to a pH value of 0.67. A partial stream amounting to 10% should be adjusted to a pH value pf 0.6 if a final pH-value of 1.7 is desired after the recombination with the main stream.

In order to effect a quantitative destruction of the oxyacids of halogens, as far as possible, and/or of the salts of such acids, and to decrease the risk of a formation of $ClO_2$, the partial stream is desirably adjusted to a pH value below 0.8 and is selected to be as small as is required in view of the desired final pH value.

The adjustment to a pH value below 1 is preferably effected at a temperature above 70° C., particularly in the range of 80° to 90° C., because this promotes the decomposition.

The process according to the invention produces two results:

The acidification, particularly of a partial stream, to a pH value below 1, preferably of 0.8, results in a virtually quantitative destruction of the oxyacids of halogens and/or of the salts of such acids.

The adjustment of the anolyte to a pH value in the range of 1.0 to 6.0 restricts the formation of the oxyacids of halogens and/or of the salts of such acids to small values, which do not have detrimental effects on the current efficiency. Particularly desirable results in this respect are obtained if, according to a preferred further feature of the invention, the electrolyte to be fed to the anode chamber is adjusted to a pH value in the range of 1 to 2.5.

In the preferred embodiment of the invention, a partial stream is branched from said stream and is subjected to a treatment by which the oxyacids of halogens and/or the salts of such acids are virtually completely destroyed. Steady-state conditions are finally obtained under which oxyacids of halogens are destroyed by the treatment of the partial stream at the rate at which said oxyacids are formed in the anode chamber. For instance, when a partial current of 10% is branched off and is adjsuted to a pH value of 0.6 and the anolyte has a pH value of 1.7 after the streams have been recombined, the content of the oxyacid of chlorine and/or the salts of such acid will be maintained at 20 grams per liter, calculated as sodium chlorate.

According to a further preferred feature of the invention the electrolyte leaving the anode chamber of the membrane cell is not outgassed, as is generally usual, before it is strengthened with alkali halide, but is adjusted to a pH value of about 7 to 10 by an addition of alkaline solution. As a result, the dissolved halogen gas which is present in slight quantities is transformed into oxyacid of halogens and/or into the salts of such acid and a major portion of the resulting compounds is then eliminated by the acidification effected after the acidification and the removal of the impurities.

The membrane cell itself has the structural elements known per se. Suitable membrane materials include polyfluorohydrocarbons having cation-exchanging groups, such as sulfonic acid groups ($SO_3H$), carboxylic acid groups (COOH) and phosphoric acid groups ($PO_3H_2$). Individual fluorine atoms may be be replaced by other halogen atoms, particularly chlorine atoms. See also D. Bergner, l.c., page 441, right-hand column, et seq., for suitable membrane materials.

The anodes used in carrying out the process according to the invention may consist of graphite. Particularly suitable are electrodes which consist of titanium, niobium or tantalum and are coated with noble metal or noble metal oxide, or so-called dimensionally stable anodes having an electrolytic activity that is due to the presence of mixed oxides of noble metals and film-forming metals, particularly titanium.

The cathodes may particularly consist of steel and nickel, nickel in the form of the so-called porous doubleskeleton cathodes.

If a partial stream is branched off in the preferred embodiment of the process according to the invention, the rate and pH value of the partial stream can be controlled during the operation of the membrane cell so as to change the pH value of the anolyte. More specifically, an ageing of the membrane can be compensated by a decrease of the pH value of the anolyte. Besides, different membrane cells can be supplied with anolytes having different pH balues if the partial and main streams are controlled to have different flow rates.

BRIEF DESCRIPTION OF DRAWING

The accompanying drawing is a flow diagram of a preferred embodiment of the invention.

DESCRIPTION OF SPECIFIC EMBODIMENT

The invention will now be explained more in detail and by way of example with reference to the annexed flow diagram and the Example.

Two membrane cells for the electrolysis of sodium chloride have anode chambers 1. Chlorine gas is withdrawn through a conduit 20. The electrolyte which has a decreased sodium chloride content is fed through conduits 2 and 3 into a treating chamber 4. In the latter, sodium hydroxide solution fed through conduit 5 is added to the electrolyte to adjust the latter to a pH value of 7 to 10. Dissolved chlorine gas is thus converted into hypochlorite, which is partly or entirely transformed into sodium chlorate, in dependence on the pH value, temperature and time.

The solution then enters the saturator 6, which is fed through conduit 7 with common salt to increase the concentration of the solution to about 310 g/l. The succeeding unit 8 (precipitator) is fed through conduit 9 with sodium hydroxide solution until a pH value of about 11 has been reached. As a result, the impurities, particularly the calcium and magnesium ions, are precipitated. After the solution has been treated in the filter unit 10 and the precipitated impurities have been discharged through conduit 11, the solution enters conduit 12 and is divided into a partial stream 13 and a main stream 14. Whereas the main stream 14 flows toward the anode chambers 1 the partial stream 13 is adjusted to a pH value below 1.0, preferably below 0.8, in the unit 15 (decomposer), which is fed through conduit 16 with concentrated hydrochlorid acid. As a result, the oxyacids of chlorine and/or the salts of such acids are substantially destroyed with formation of chlorine. The chlorine gas is combined in a conduit 21 with the chlorine gas coming from the anode chambers 1 of the membrane cells.

The solution then runs off through conduit 17 and is mixed with the main stream solution 14. The combined streams are fed through conduits 18 and 19 to the anode chambers 1. Suitable control valves may be incorporated and may be used to vary the mixing ratio between the solutions flowing through conduits 18 and 19 so that the pH value can be varied too.

EXAMPLE

The electrolysis was carried out in two membrane cells having steel cathodes and dimensionally stable anodes on the basis of titanium. The membranes consisted of ethylene diamine-modified Nafion® (a product of DuPont). A cell voltage of 3.8 volts was applied.

The anode chambers 1 of the membrane cells were fed with a brine which contained 310 grams NaCl per liter and had a pH value of 1.7 and a temperature of 85° C. The residence time of the anolyte in the anode chambers 1 was controlled so that 25 grams NaCl were removed per liter. Within that time, about 2 grams oxyacids of chlorine, calculated as $NaClO_3$, were formed per liter.

The electrolyte solution leaving the anode chambers 1 was adjusted to pH 8 in the treating chamber 4 by an addition of sodium hydroxide solution and in the saturator 6 was strengthened to an NaCl concentration of 310 grams per liter and in the unit 8 was adjusted to pH 11 by an addition of further sodium hydroxide solution in order to precipitate the impurities. After a filtration in the filter unit 10, the electrolyte was adjusted to pH 1.7 in the initial phase of the process and was then recycled to the anode chamber. When the concentration of oxyacid of chlorine had increased to 22 grams per liter, calculated as $NaClO_3$, a partial stream of 10% was removed from the pure brine leaving the filter unit 10 and was supplied through conduit 13 to unit 15 and in the latter was adjusted to pH 0.6 by an addition of hydrochloric acid. As a result, the content of oxyacid of chlorine in the partial stream was decreased to 2 grams per liter. The resulting chlorine gas was fed through conduit 21 to conduit 20.

The partial stream from which most of the oxygen acid of chlorine had been removed was recombined with the main stream of pure brine flowing in conduit 14. The mixed stream had a pH value of 1.7 and an average concentration of oxyacids of chlorine amounting to 20 grams per liter, calculated as $NaClO_3$. That concentration was maintained throughout the time in which the process was carried out.

If the pH value of the pure brine leaving the filter unit is merely increased to 1.7, the concentration of oxyacids of chlorine reaches 140 grams per liter after a relatively short operation so that the solubility of sodium chloride decreases to 270 grams per liter and the discharge potential increases by 50 mV. This results in secondary reactions and in a considerable decrease in current efficiency.

What is claimed is:

1. In a process of electrolyzing an aqueous solution of an alkali metal halide in a membrane cell where halogen oxyacids and/or their salts are formed, and in which a pH value above 1.0 is maintained in the anode chamber and the alkali metal halide solution is moved through the anode chamber and, thereafter, through at least one zone in which its concentration and pH are increased the improvement wherein the pH of at least a portion of the alkali metal halide solution whose concentration has been increased is thereafter adjusted to a pH value below 1.0 and said solution is subsequently adjusted to a pH value in the range of 1.0 to 6.0 and thereafter fed to the anode chamber.

2. A process according to claim 1 characterized in that a partial stream of the so concentrated alkali halide solution amounting to up to 20 percent of the alkali metal halide solution whose concentration has been increased is adjusted to such a pH value below 1.0 and the resultant partial stream is thereafter recombined with the balance of the alkali metal halide solution from which it was taken whereby the so-recombined stream has a pH of 1.0 to 6.0.

3. A process according to claim 2 wherein the partial stream is adjusted to a pH value below 0.8.

4. A process according to claim 1 the adjustment to a pH value below 1.0 is effected at a temperature above 70° C.

5. A process according to claim 4 wherein said adjustment is effected at 80° to 90° C.

6. A process according to claim 2 wherein said partial stream amounts to 8 to 15 percent of the so concentrated alkali metal halide solution.

7. A process according to claim 1 wherein the alkali metal halide solution fed into the anode chamber has a pH value in the range of 1.0 to 2.5.

8. A process according to claim 1 wherein the alkali metal halide solution leaving the anode chamber is adjusted to a pH value of 7 to 10.

9. In a process of electrolyzing an aqueous solution of an alkali metal halide in a membrane cell where halogen oxyacids and/or their salts are formed, and in which a pH value above 1.0 is maintained in the anode chamber and the alkali metal halide solution is moved through the anode chamber and, thereafter, through at least one zone in which its concentration and pH are increased the improvement wherein the pH of a partial stream amounting to up to 20 percent of the alkali metal halide solution whose concentration has been increased is adjusted to such a pH value below 1.0 and the resultant partial stream is thereafter recombined with the balance of the alkali metal halide solution from which it was taken whereby the so-recombined stream has a pH of 1.0 to 6.0.

10. A process according to claim 1 wherein said membrane cell consists essentially of an anode, cathode and membrane disposed therebetween to separate anolyte from catholyte.

* * * * *